US006000259A

United States Patent [19]

Wolters et al.

[11] Patent Number: 6,000,259

[45] Date of Patent: Dec. 14, 1999

[54] POSITION-CONTROLLED EDGING STAND ARRANGED IN FRONT OF A FINISHING TRAIN FOR CONTINUOUSLY CAST STRIP MATERIAL

[75] Inventors: Hermann Wolters, Hilchenbach; Wolfgang Spies, Siegen, both of Germany

[73] Assignee: SMS Schloemann-Siemag Aktiengesellschaft, Düsseldorf, Germany

[21] Appl. No.: 09/052,426

[22] Filed: Mar. 31, 1998

[30] Foreign Application Priority Data

Apr. 2, 1997 [DE] Germany ..... 197 13 604

[51] Int. Cl.[6] ..... B21B 37/00

[52] U.S. Cl. ..... 72/13.3; 72/10.4; 72/14.4; 72/250; 72/366.2

[58] Field of Search ..... 72/10.1, 10.4, 72/10.6, 12.1, 13.1–13.4, 14.4, 14.5, 21.4, 21.5, 28.2, 31.07, 225, 229, 234, 250, 365.2, 366.2

[56] References Cited

U.S. PATENT DOCUMENTS

| | | | |
|---|---|---|---|
| 4,532,789 | 8/1985 | Bruinsma et al. | 72/234 |
| 4,590,778 | 5/1986 | Klockner et al. | 72/250 |
| 4,712,414 | 12/1987 | Kokubo et al. | 72/199 |
| 4,803,862 | 2/1989 | Schulze et al. | 72/199 |
| 5,394,727 | 3/1995 | Griess et al. | 72/247 |

FOREIGN PATENT DOCUMENTS

| | | | |
|---|---|---|---|
| 57-31406 | 2/1982 | Japan | 72/10.4 |
| 2-274304 | 11/1990 | Japan | 72/421 |

*Primary Examiner*—Lowell A. Larson
*Assistant Examiner*—Ed Tolan
*Attorney, Agent, or Firm*—Friedrich Kueffner

[57] ABSTRACT

A finishing train for continuously cast strip material and a method of operating the finiching train, wherein an edging stand is arranged in front of the finishing train for preventing strip material cracks occurring during the reduction of the strip thickness at the strip edges, wherein position control circuits are arranged in front of the adjusting device of the edging stand. The arrangement includes a superimposed pressure control circuit (edging degree monitoring circuit) which responds to the adjusting force of the edging stand and the position thereof, and a load limiting control unit which responds to adjusting forces of the grooved rolls of the edging stand exceeding permissible values and/or to loads of the drive motors of the grooved rolls exceeding permissible values, for increasing the predetermined gap width and/or reducing the desired pressure of the adjusting device of the edging stand.

6 Claims, 1 Drawing Sheet

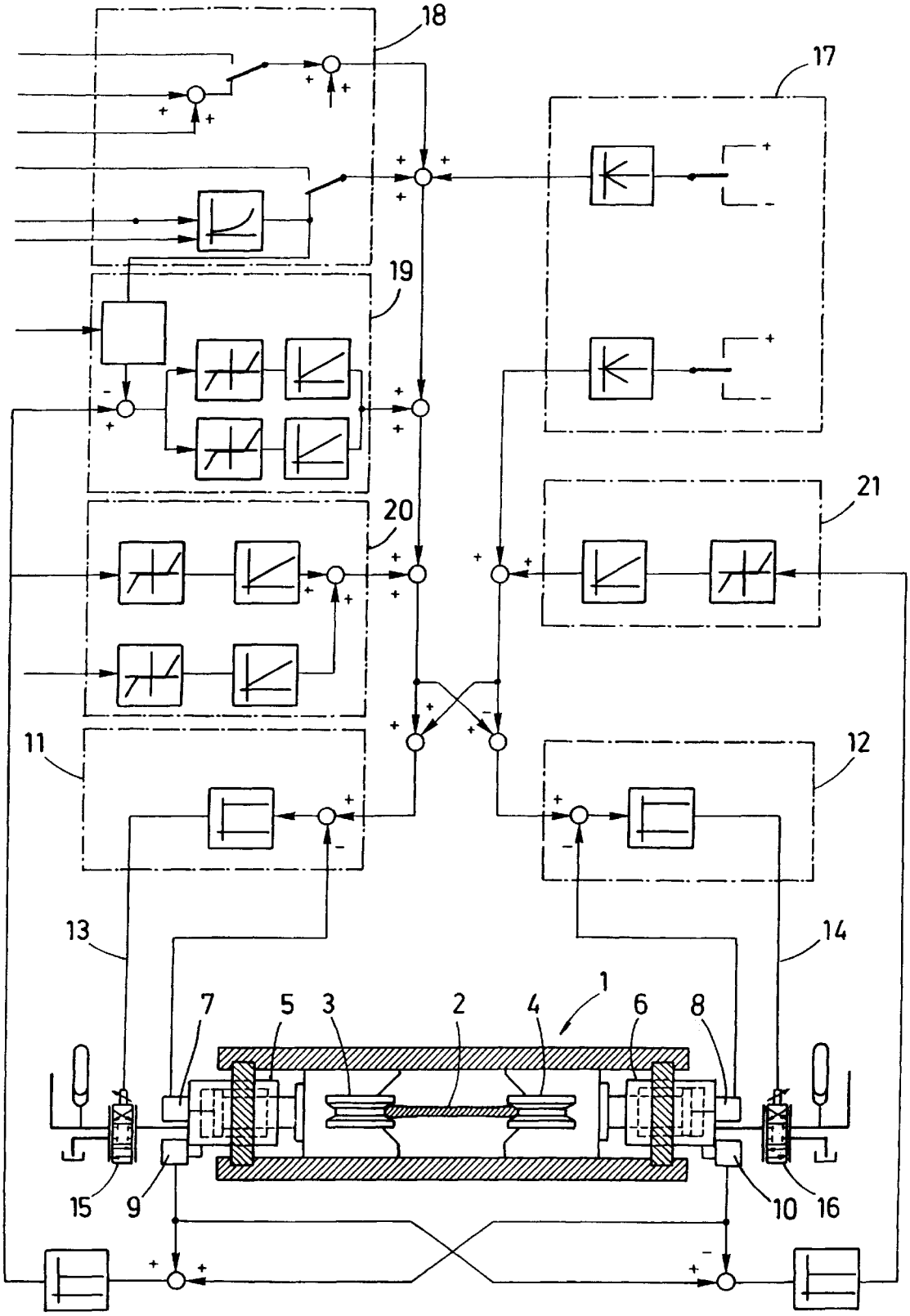
18
17
19
20
21
11
12
13
14
1
7
5
3
2
4
6
8
15
9
10
16

POSITION-CONTROLLED EDGING STAND ARRANGED IN FRONT OF A FINISHING TRAIN FOR CONTINUOUSLY CAST STRIP MATERIAL

BACKGROUND OF THE INVENTION

1. Field of the Invention

The present invention relates to a finishing train for continuously cast strip material with an edging stand arranged in front of the finishing train for preventing strip material cracks occurring during the reduction of the strip thickness at the strip edges, wherein position control circuits are arranged in front of the adjusting device of the edging stand.

The present invention further relates to a method of operating the edging stand and the finishing train.

2. Description of the Related Art

It has been found useful to initially roll non-cast billets in roughing stands in a reversing operation and then to convey the billets to the finishing train. It has been found substantially less cumbersome to continuously cast thin strips in molds of continuous casting plants and to convey the strips to a finishing train after appropriate cooling and solidification of the strip. It has been found to be economical to roll the initial strip while it is still hot and, thus, easily deformable already in the first stand of the finishing train with a high reduction.

Since extreme grain coarsening occurs in the material structure of the continuously cast initial strip because it remains at high temperatures for a long period of time, there is always the danger of the occurrence of cracks in the edge areas of the strip when high pass reductions of the coarse-granular material occurs in the first stand of the finishing train; these cracks make it impossible to utilize the full width of the strip and make it necessary to trim the finished strip which requires an additional operation and is cost-intensive because of the production of scrap.

Therefore, it has already been proposed to edge the strip material in the edge areas thereof prior to entering the finishing train. The material deformation caused by edging converts the originally coarse-granular structure into a crushed structure with a recrystallization occurring only at this point in time, wherein the finely granular structure of the recrystallization excludes cracks in the edge areas of the strip material even when high thickness reductions are carried out.

SUMMARY OF THE INVENTION

Therefore, it is the primary object of the present invention to provide an arrangement of the above-described type and a method for operating the edging stand arranged in front of the finishing train which ensure that the initial strip is taken up by and inserted into the first stand of the finishing train, on the one hand, and under all circumstances produce a sufficient deformation of the strip edge areas to ensure the necessary structural conversion, on the other hand. In addition, a problem-free insertion of the strip should be ensured even when disturbance factors occur and it must be absolutely prevented that overloading occurs of the edging stand and of the adjusting devices and the drive motors for the edging stand.

In accordance with the present invention, the arrangement includes a superimposed pressure control circuit (edging degree monitoring circuit) which responds to the adjusting force of the edging stand and the position thereof, and a load limiting control unit which responds to adjusting forces of the grooved rolls of the edging stand exceeding permissible values and/or to loads of the drive motors of the grooved rolls exceeding permissible values, for increasing the predetermined gap width and/or reducing the desired pressure of the adjusting device of the edging stand.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a schematic sectional view of an edging stand and includes a block diagram of the system according to the present invention.

DESCRIPTION OF THE PREFERRED EMBODIMENTS

The drawing shows an edging stand 1 in which the continuously cast strip 2 can be edged in its edge areas. The edging stand 1 has two grooved rolls 3,4 which can be positioned by means of adjusting cylinders 5,6. The adjusting cylinders 5,6 are provided with actual position sensors 7,8 and actual pressure sensors 9, 10. The actual position sensors 7,8 produce the actual position values for the position control circuits 11,12 whose outputs 13, 14 act on valves 15, 16 which control the application of pressure medium against the adjusting cylinders 5,6.

The predetermined position values for the gap width, i.e., the desired position values for the position control circuits 11, 12 is effected through a model computation in the computer 18. An additional manual adjustment can be provided through an input unit 17. From the material-specific values of the material to be rolled, the planned reduction in the first stand of the finishing train, the cast strip width and/or the finished strip width in conjunction with the back spreading action, a desired position value is determined in the computer 18, wherein the desired position value is placed on the position control circuits 11, 12.

The material-specific values of the material to be rolled as well as the reduction in the first stand of the finishing train can be obtained from the computer 18 in order to determine in an edging degree monitoring circuit 19 together with the strip temperature the edging force to be expected. The edging force to be expected is compared to the actual summed edging force determined by the actual pressure sensors 9, 10. If there are deviations, the position control circuits 11, 12 of the adjusting cylinders 5, 6 are subjected to correspondingly computed position correction values with the actual force approaching the force to be expected until the differences are eliminated.

To ensure that the edging degree monitoring unit does not cause changes in the adjustment in the case of extremely small differences between the force to be expected and the summed edging force, control units are provided which have a predeterminable dummy strip. The position control circuits are only influenced when the force deviations are above or below the predeterminable maximum or minimum values of this dummy strip.

When summed forces are measured which exceed the predeterminable forces, an overload limiting circuit 20 produces additional position correction values for ensuring that the position control circuits 11, 12 can be influenced in such a way that the measured summed edging force is reduced. In addition, the current of the drive motors, not shown, of the grooved rolls 3, 4 are evaluated in the overload limiting circuit 20. When the summed current exceeds predeterminable values, the position control circuits 11, 12 are also influenced in order to reduce the measured summed currents.

Also in this case, maximum current values are provided to the overload limiting control unit 20 during a dummy strip, so that the overload limitation begins only after the predetermined pressure or current values have been exceeded.

The pressure values measured by the actual pressure sensors 9, 10 are subtracted from each other in order to obtain a difference edging force. When a difference edging force occurs, this is an indication that a greater load is applied to one of the grooved rolls 3 or 4 than to the other. Since the grooved rolls 3, 4 operate against each other, the pressure at the actual pressure sensor 9 is equal to the pressure at the actual pressure sensor 10. When there are differences, they can only be caused by the strip 2 which is secured by a laterally immovable guide device, on the one hand, and in the finishing train, on the other hand. When the strip 2 enters the edging stand 1, for example, in a saber-shape, a greater load is applied to one of the grooved rolls 3 or 4. The difference edging force is placed on a difference load monitoring circuit 21 which, when predeterminable difference edging forces are exceeded, controls the position control circuits 11 and 12 so as to reduce the difference edging force in such a way that equal loads are applied in the same directions against the adjusting cylinder in order to achieve a gap displacement.

The invention is not limited by the embodiments described above which are presented as examples only but can be modified in various ways within the scope of protection defined by the appended patent claims.

We claim:

1. A finishing train for continuously cast strip material with an edging stand arranged in front of the finishing train for preventing the formation of material cracks at strip edges during a reduction of a strip thickness, the edging stand having grooved rolls and drives for the grooved rolls, wherein position control circuits are provided for an adjusting device of the edging stand, further comprising a superimposed pressure control circuit with a predeterminable response interval responding to an adjusting force of the edging stand and influencing a position of the edging stand, and a load limiting control means responding to at least one of adjusting forces of the grooved rolls of the edging stand exceeding permissible values and loads of the drive motors of the grooved rolls exceeding permissible values, wherein the load limiting control means is configured to at least one of increase a predetermined gap width and reduce a desired pressure of the adjusting devices of the edging stand.

2. The finishing train with edging stand in accordance with claim 1, wherein the pressure control circuit comprises an edging degree monitoring circuit.

3. The finishing train with edging stand in accordance with claim 1, comprising an additional control means for changing desired positions of the grooved rolls in one direction only when significant values of a difference of the two adjusting forces of the adjusting devices of the grooved rolls of the edging stand occur.

4. The finishing train with edging stand in accordance with claim 3, wherein the additional control means comprises a difference load monitoring circuit.

5. A method of operating an edging stand arranged in front of a finishing train for continuously cast strip material for preventing material cracks occurring in areas of strip edges of the strip material when the strip material is reduced, the edging stand including grooved rolls, drive motors, adjusting devices and position control circuits for the adjusting devices, the method comprising using additional control circuits for (a) limiting adjusting forces of the adjusting devices of the grooved rolls of the edging stand and/or increasing a gap width of the grooved rolls before the strip material is taken up by a first stand of the finishing train;

(b) using a pressure control circuit for determining a desired force to be applied for achieving a degree of edging in dependence on a predetermined degree of edging defined by a width of the strip material, a temperature of the strip material, a composition of the strip material as well as a planned reduction of the strip material in the first stand of the finishing train, and effecting by the pressure control circuit an at least partial readjustment of an actual position only after a tolerance range of the deviation of an actual force from the desired force has occured, and (c) using an overload limiting control means when exceeding permissible maximum summed edging forces and/or when exceeding a permissible maximum load of the drive motors of the edging stand, for reducing a gap width predetermined by the positions of the adjusting devices of the edging stand and/or for reducing the desired pressures for the adjusting devices until dropping below the permissible maximum summed edging forces or the permissible maximum load.

6. The method according to claim 5, comprising changing a desired position of the grooved rolls so as to shift the gap in one direction and by identical distances when significant differences of the adjusting forces of the two grooved rolls occur by using control circuits as additional control units.

* * * * *